US009482398B2

(12) United States Patent
Luk

(10) Patent No.: US 9,482,398 B2
(45) Date of Patent: Nov. 1, 2016

(54) LIGHTWEIGHT AND THERMALLY EFFICIENT LED DOWN LIGHT

(71) Applicant: John F. Luk, Flushing, NY (US)

(72) Inventor: John F. Luk, Flushing, NY (US)

(73) Assignee: DeNovo Lighting LLC, Flushing, NY (US)

( * ) Notice: Subject to any disclaimer, the term of this patent is extended or adjusted under 35 U.S.C. 154(b) by 108 days.

(21) Appl. No.: 14/672,155

(22) Filed: Mar. 28, 2015

(65) Prior Publication Data

US 2016/0281939 A1 Sep. 29, 2016

Related U.S. Application Data

(60) Provisional application No. 61/978,313, filed on Apr. 11, 2014.

(51) Int. Cl.

| | |
|---|---|
| ***F21S 8/02*** | (2006.01) |
| ***F21V 21/04*** | (2006.01) |
| ***F21V 19/00*** | (2006.01) |
| ***F21V 23/00*** | (2015.01) |
| ***F21V 29/70*** | (2015.01) |

(52) U.S. Cl.

CPC ..... *F21S 8/026* (2013.01); *F21V 19/004* (2013.01); *F21V 21/047* (2013.01); *F21V 23/008* (2013.01); *F21V 29/70* (2015.01)

(58) Field of Classification Search

CPC .... F21S 8/026; F21V 19/004; F21V 21/047; F21V 23/008; F21V 29/70

See application file for complete search history.

(56) References Cited

U.S. PATENT DOCUMENTS

| | | | | |
|---|---|---|---|---|
| 8,201,968 | B2 | 6/2012 | Maxik et al. | |
| 8,672,518 | B2 | 3/2014 | Boomgaarden et al. | |
| 2015/0092421 | A1* | 4/2015 | Boomgaarden ..... | F21S 8/026 362/294 |

* cited by examiner

*Primary Examiner* — Stephen F Husar

(57) ABSTRACT

A lightweight and thermally efficient LED lighting module is disclosed for recessed down light can retrofits, or as new down light installations mountable to different size junction boxes consisting of a combination heat sink and trim ring unitary metal dish for the attachment of at least one LED array mounted to a circuit board, or at least one chip-on-board or COB LED array, further including at least two removable springs or clips, junction box mounting screw clearance holes, an optional external dimmable LED driver, and a diffusion lens cover installed to the front of the LED lighting module.

4 Claims, 12 Drawing Sheets

FIG.11

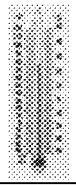

| | | | | | | | | |
|---|---|---|---|---|---|---|---|---|
| **Engineering Testing Record** | | | Date Requested | | Date Completed | | | |
| | | | Tested By | | Test Number | | | |
| | | | **Results** | 66.4 < 70 OK | | | | |
| Catalog Number | 4" Light | | Description | | | | | |
| Ballast information | P/N | | Supplier/part number: | | | | | |
| | Start type | | Electrical Rating | | 120V | | | |
| Lamp Information | P/N | | Supplier/part number: | | | | | |
| | P/N | | Supplier/part number: | | | | | |
| Primary (Input) | Volts: | 120V | Amps | | Watts | | P.F. | |
| Secondary (Output) | Volts: | | Amps | | Watts | | P.F. | |
| Mounting | | | | | | | | |
| Notes | | | | | | | | |
| Test Duration | 8 | hrs | | | | | | |

| | Stabilized times | | | Temp. | |
|---|---|---|---|---|---|
| **Thermo-couple location** | Time | Ambient | Reading | Limit | |
| 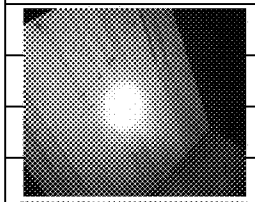 | 1:00 | 23.3 | 50.6 | | 1 |
| | 1:30 | 23.5 | 64.2 | | |
| | 2:00 | 23.6 | 64.5 | | 2 |
| | 2:30 | 23.6 | 64.5 | | |
| | 3:00 | 23.7 | 64.6 | | 3 |
| | 3:30 | 23.7 | 64.6 | | |
| | 4:00 | 23.7 | 64.6 | | 4 |
| | 4:30 | 23.7 | 64.6 | | |
| 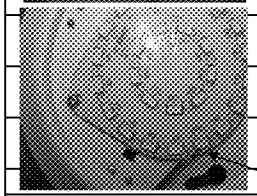 | 5:00 | 23.7 | 64.7 | | 5 |
| | 5:30 | 23.7 | 64.7 | | |
| | 6:00 | 23.7 | 64.7 | | 6 |
| | 6:30 | 23.6 | 64.7 | | |
| | 7:00 | 23.7 | 64.7 | | 7 |
| | 7:30 | 23.6 | 64.7 | | |
| Ambient 25 | | | | | C |
| MAX | | 23.7 | 64.7 | | |

T/C Diagram

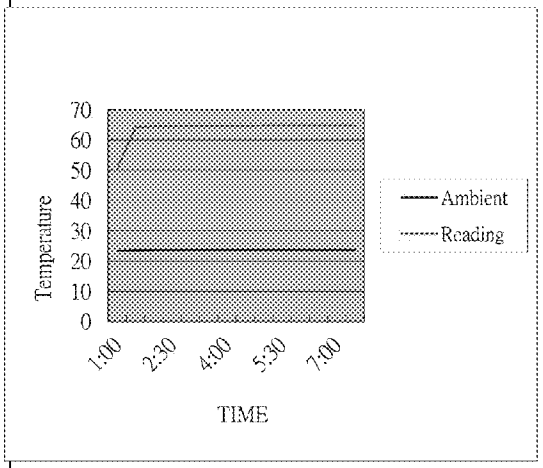

— = this surface | ---- = opposite surface

FIG. 12

| | | | | | | | | |
|---|---|---|---|---|---|---|---|---|
| **Engineering Testing Report** | | | | | Date Completed | | | |
| | | | | | Test Number | | | |
| | | | | | 66.4 < 70 OK | | | |
| Catalog Number | 6" Light | | | | | | | |
| Ballast information | P/N | | Supplier/part number: | | | | | |
| | Start type | | Electrical Rating | | 120V | | | |
| Lamp Information | P/N | | Supplier/part number: | | | | | |
| | P/N | | Supplier/part number: | | | | | |
| Primary (Input) | Volts: | 120V | | | Watts | | P.F. | |
| Secondary (Output) | Volts: | | | | Watts | | P.F. | |
| Mounting | | | | | | | | |
| Notes | | | | | | | | |
| Test Duration | 8 | hrs | | | | | | |

| Thermo-couple location | Stabilized times Time | Ambient | Reading | Temp. Limit | T/C |
|---|---|---|---|---|---|
| | 1:00 | 23.4 | 50.7 | | 1 |
| | 1:30 | 23.6 | 66 | | |
| | 2:00 | 23.7 | 66.1 | | 2 |
| | 2:30 | 23.7 | 66.2 | | |
| | 3:00 | 23.7 | 66.2 | | 3 |
| | 3:30 | 23.6 | 66.1 | | |
| | 4:00 | 23.8 | 66.3 | | 4 |
| | 4:30 | 23.7 | 66.3 | | |
| | 5:00 | 23.7 | 66.3 | | 5 |
| | 5:30 | 23.7 | 66.4 | | |
| | 6:00 | 23.7 | 66.4 | | 6 |
| | 6:30 | 23.7 | 66.3 | | |
| | 7:00 | 23.7 | 66.4 | | 7 |
| | 7:30 | 23.7 | 66.4 | | |
| Ambient 25 | | | | | C |
| MAX | | 23.8 | 66.4 | | |

Diagram

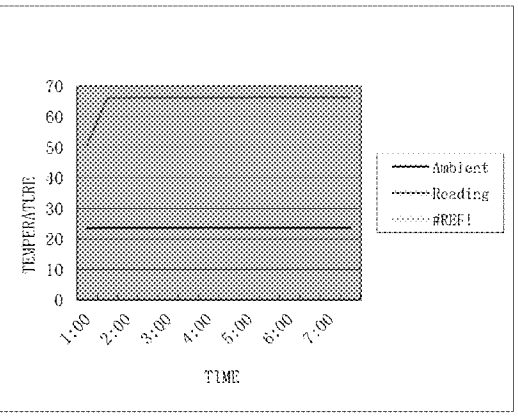

— = this surface  ····· = opposite surface

LIGHTWEIGHT AND THERMALLY EFFICIENT LED DOWN LIGHT

PRIORITY DOCUMENT

This patent application claims priority of Provisional Patent Application No. 61/978,313 entitled, "Lightweight and thermally efficient LED down light" filed on Apr. 11, 2014.

FIELD OF THE INVENTION

The present invention relates generally to a lightweight LED lighting module with improved thermal efficiency that can be used in retrofit recessed down light can applications or for new down light installations.

BACKGROUND OF THE INVENTION

Incandescent tungsten filament lamps were the first source of light that was created. These incandescent lamps were later used on dimmers that controlled the amount of power going into the lamps to provide dimming of the light output and for energy savings. HID or metal halide lamps and fluorescent lamps were later discovered that offered increased lamp life and brighter outputs over the incandescent lamps. These HID or fluorescent lamps operated with a ballast that first ignited an arc and then limited the power to the lamp to keep the arc operating. Certain HID or fluorescent lamps could be used with special dimming ballasts that could be dimmed for additional energy savings.

More recently, advances in LED brightness and efficacy have allowed LED lamps and LED modules to be developed that could offer even longer lamp life and brighter outputs when properly configured, to compete with HID or fluorescent lamps. A driver is used to provide the correct power to the LEDs either through PWM, constant voltage, or constant current. The LED lamps and LED modules could be hardwired directly to the driver in an internal or external configuration, or can be eliminated with the use of dimmable AC LEDs and special IC chips. The drivers could be made dimmable for use with the already inherent nature of energy savings provided by the LEDs.

For new designs and ease of retrofits, it is desirable to have one LED light or LED module that can be installed into existing incandescent, compact fluorescent or HID fixtures to ultimately create a longer lasting and energy efficient LED light fixture.

The present invention provides for an LED light or LED module that allows an end user to have a retrofit LED lamp option to existing halogen, compact fluorescent, or HID fixtures. The same present invention also provides for an LED light or LED module option that allows an end user to readily install a new LED light or LED module as a recessed down light for new installations.

Lastly, the present invention will provide for a thermally efficient, better, and lightweight LED light that can be installed in multiple applications including new recessed down light installations with very low ceiling height clearances.

DESCRIPTION OF THE RELATED ART

Companies including Lighting Science Group and Commercial Electric for Home Depot among many others, offer LED down light fixtures that can be use in existing fixtures as retrofits or as an LED fixture in new recessed down light installations. However, all of these models use external bulky and heavy heat sinks attached to a separate plate positioned at the rear of the fixtures to provide cooling for the LEDs. The additional heat sinks add extra and unnecessary weight, and additional cost to the fixtures. The height of the heat sink in some fixtures also makes the LED down light fixtures higher than necessary, thereby preventing its use in very low profile ceiling or wall mount applications. Some background on a typical two piece configuration for a recessed LED down light can be found in U.S. Pat. No. 8,201,968 issued to Maxik et al. titled, "Low Profile Light" and assigned to Lighting Science Group Corporation, and also in U.S. Pat. No. 8,672,518 issued to Boomgaarden et al. titled, "Low Profile Light and Accessory Kit for the same" that is also assigned to Lighting Science Group Corporation.

The present invention is an improvement over other inventions. It uses a single unitary metal dish preferably made of aluminum for better thermal conductivity and makes the overall LED fixture more lightweight. The metal dish can be made from different manufacturing processes including, but not limited to deep draw, stamping, spinning, metal forming, and other methods for making this multipurpose combination heat sink and trim assembly for the mounting of an LED board or LED arrays. This metal dish eliminates the need for having a separate trim ring and heat sink, thereby reducing overall weight and cost of the LED light or LED module. Having a single piece also allows for better thermal conductivity of the LED board or LED arrays where heat from the LEDs are cooled directly by the metal dish into the trim ring of the LED light or LED module without the need to go through multiple surfaces offering better and more efficient thermal transfer. In addition, the metal dish also serves as the means for mounting the entire LED light or LED module to a junction box for new installation applications, or the attachment of removable metal springs or clips and brackets for retrofit applications into existing lighting down light can fixtures.

The device of the present invention consists primarily of a main metal dish. The main metal dish serves multiple purposes. Primarily, it serves as an immediate surface in which to mount an LED printed circuit board or a COB or chip-on-board LED module array, and serve as a thermally conductive heat sink. The circuit board contains at least one string of LEDs or LED arrays. Likewise the COB may contain at least one string of LEDs or LED arrays. The second purpose is to provide a decorative trim ring for LED light fixture for retrofit and new installation applications. Lastly, the main metal dish contains screw clearance holes for mounting to different size junction boxes for new installations, and also has provisions on it for the mounting of removable brackets, clips, and springs, or for the attachment of only springs provided for retrofitting the complete LED light assembly into an existing recessed down light can. Provisions are also provided on the main metal dish for the mounting of an LED light engine, an optional external driver, and a diffusion lens.

The preferred embodiment of the present invention consists of a main combination heat sink and trim ring metal dish, removable mounting clips or springs, LED light engine, diffusion lens, and an external AC to DC dimmable LED driver.

An alternate embodiment of the present invention consists of a main combination heat sink and trim ring metal dish, removable mounting clips or springs, dimmable AC LED light engine with internal controller, and a diffusion lens.

SUMMARY OF THE INVENTION

The device of the present invention includes in its most basic form, a main metal dish, removable springs, an LED light engine, an optional LED driver, and a diffusion snap-in lens.

The preferred embodiment is therefore a dimmable device that has a. combination heat sink and trim ring main metal dish for mounting an LED circuit board or LED light engine to one side of the dish. The circuit board contains at least one string of LEDs or LED arrays. Likewise the COB may contain at least one string of LEDs or LED arrays. Removable brackets containing springs or separate spring clips are attached to the opposite side of the dish for allowing the LED fixture to be installed into an existing down light can in a retrofit application. For new installations of the LED fixture mounted straight to a junction box, the removable brackets containing the springs or separate spring clips are not used. An optional AC to DC dimmable driver is mounted on the same side as the removable brackets containing springs or separate spring clips. This external LED driver is then connected to the LED light engine consisting of at least one string of LEDs or LED arrays mounted to a circuit board, or a chip-on-board (COB) LED array. Lastly, a separate diffusion lens made preferably out of plastic to maintain an overall lower weight to the LED fixture is attached to the main metal dish on the same side as the LED light engine to protect the LEDs from dust and damage and also to diffuse the light that is emitted out the front of the LEDs mounted to a circuit board.

The alternate embodiment is therefore a dimmable device that has a. combination heat sink and trim ring main metal dish for mounting a dimmable AC LED circuit board or dimmable AC LED light engine to one side of the dish. The circuit board contains at least one string of AC LEDs or AC LED arrays. Likewise the AC COB may contain at least one string of LEDs or LED arrays. Removable brackets containing springs or separate spring clips are attached to the opposite side of the dish for allowing the dimmable AC LED fixture to be installed into an existing down light can in a retrofit application. For new installations of the dimmable AC LED fixture mounted straight to a junction box, the removable brackets containing the springs or separate spring clips are not used. No external driver is used with a dimmable AC LED circuit board. Instead, an on-board controller or ASIC or other means to control the LEDs including transistors or MOSFET devices may be used to operate the LEDs directly. The elimination of an external LED driver removes added weight and cost, and provides for an overall lower profile LED light in general. Lastly, a separate diffusion lens made preferably out of plastic to maintain an overall lower weight to the dimmable AC LED fixture is attached to the main metal dish on the same side as the dimmable AC LED light engine to protect the dimmable AC LEDs from dust and damage and also to diffuse the light that is emitted out the front of the dimmable AC LEDs mounted to a circuit board.

OBJECT OF THE INVENTION

It is an object of the present invention to provide a dimmable device that will work in a retrofit and in a new installation application.

It is another object of the present invention to provide a dimmable device that will fit into most existing down light can fixtures as a direct retrofit.

It is yet another object of the present invention to provide a dimmable device that can be installed into a wide variety of different junction boxes for new installations.

It is also another object of the present invention to provide a dimmable device that will provide a very lightweight LED light option for both retrofit and new installations.

It is also yet another object of the present invention to provide a dimmable and thermally efficient LED light option for both retrofit and new installations.

It is a final object of the invention to provide a dimmable device that will have a lower installed height profile for installation in tight overhead ceiling or wall installations.

While the novel features of the invention are set forth particularly in the appended claims, the invention, both as to organization and content, will be better understood and appreciated along with other objects and features thereof, from the following detailed description taken in conjunction with the drawings.

BRIEF DESCRIPTION OF THE DRAWINGS

FIG. 11 shows an engineering testing record of the thermals done on the LEDs of a circuit board installed in a 4" LED light of the preferred embodiment of the present invention as shown in FIGS. 1 and 2.

FIG. 12 shows an engineering testing record of the thermals done on the LEDs of a circuit board installed in a 6" LED light of the preferred embodiment of the present invention as shown in FIGS. 6 and 7.

The foregoing has outlined rather broadly, the features and technical advantages of the present invention, so that those skilled in the art may better understand the detailed description of the invention that follows. Additional features and advantages of the invention will be described hereinafter that form the subject of the claims of the invention. Those skilled in the art will appreciate that they may readily use the conception and the specific embodiment disclosed as a basis for modifying or designing other structures for carrying out the same purposes of the present invention. Those skilled in the art will also realize that such equivalent constructions do not depart from the spirit and scope of the invention in its broadest form.

DETAILED DESCRIPTION

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

Figure 1:
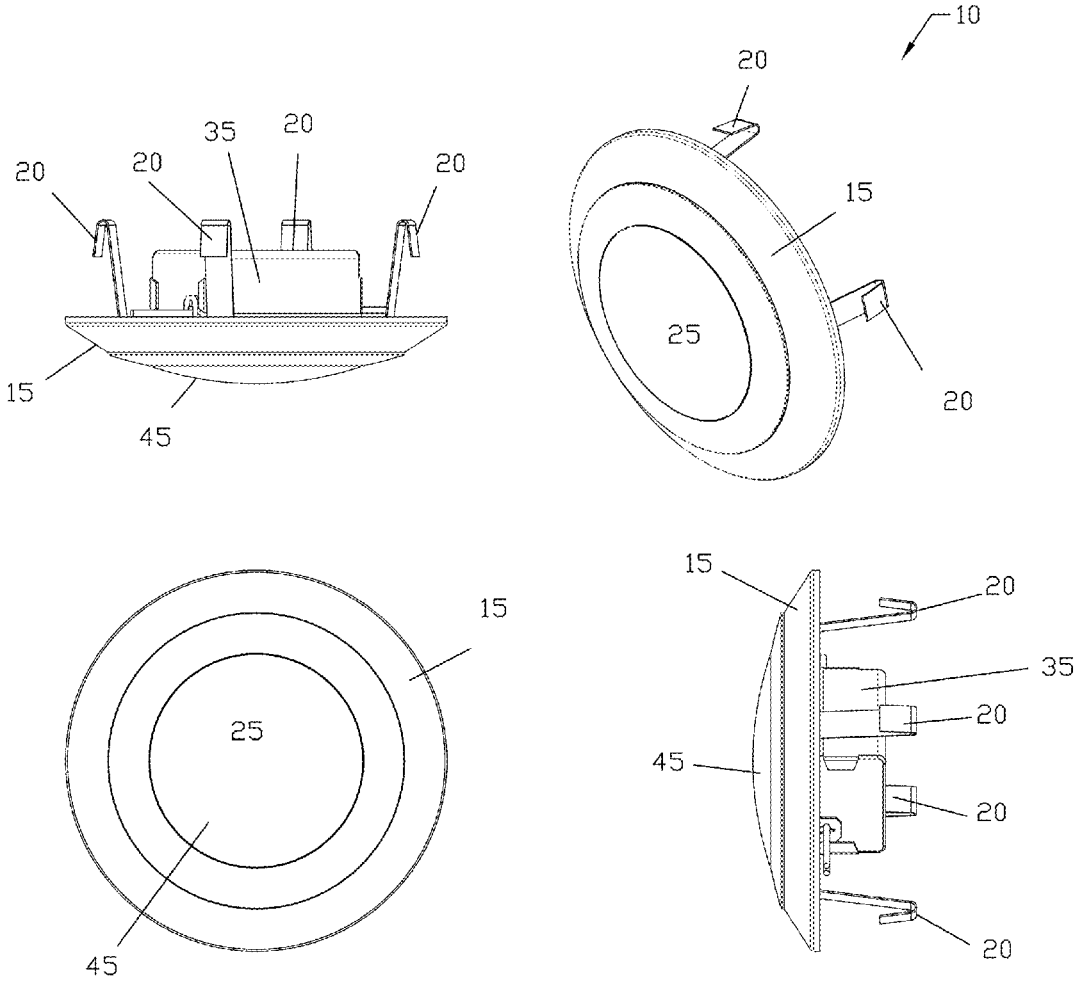
FIG. 1 shows the preferred embodiment of the present invention of a 4" LED light in front, side, and isometric views showing the main metal plate, removable mounting bracket and springs, LED circuit board (not shown), optional external dimmable LED driver, and a diffusion lens.

FIG. 1 shows the preferred embodiment of the present invention of a 4" LED light 10 in front, side, and isometric views. LED light 10 consists of a main metal dish 15 with four mounting clips 20 center around the periphery of metal dish 15. Clips 20 are preferably made of steel spring material and fastened to metal dish 15. An LED circuit board or COB 25 (not shown) is attached to the opposite side of metal dish 15. Power wires from LED circuit board or COB 25 (not shown) are fed through a clearance passage hole 30 to the back of metal dish 15 for direct connection to an external LED driver 35. Mounting screw clearance holes 40 are provided on metal dish 15 for attaching LED light 10 to a standard junction box (not shown). Lastly, diffusion lens 45 (not shown) is attached to the front of metal dish 15 to cover and protect LED circuit board or COB 25 (not shown) from dust and damage and provides the proper optics to project an even and diffused light from LED light 10.

Figure 2:
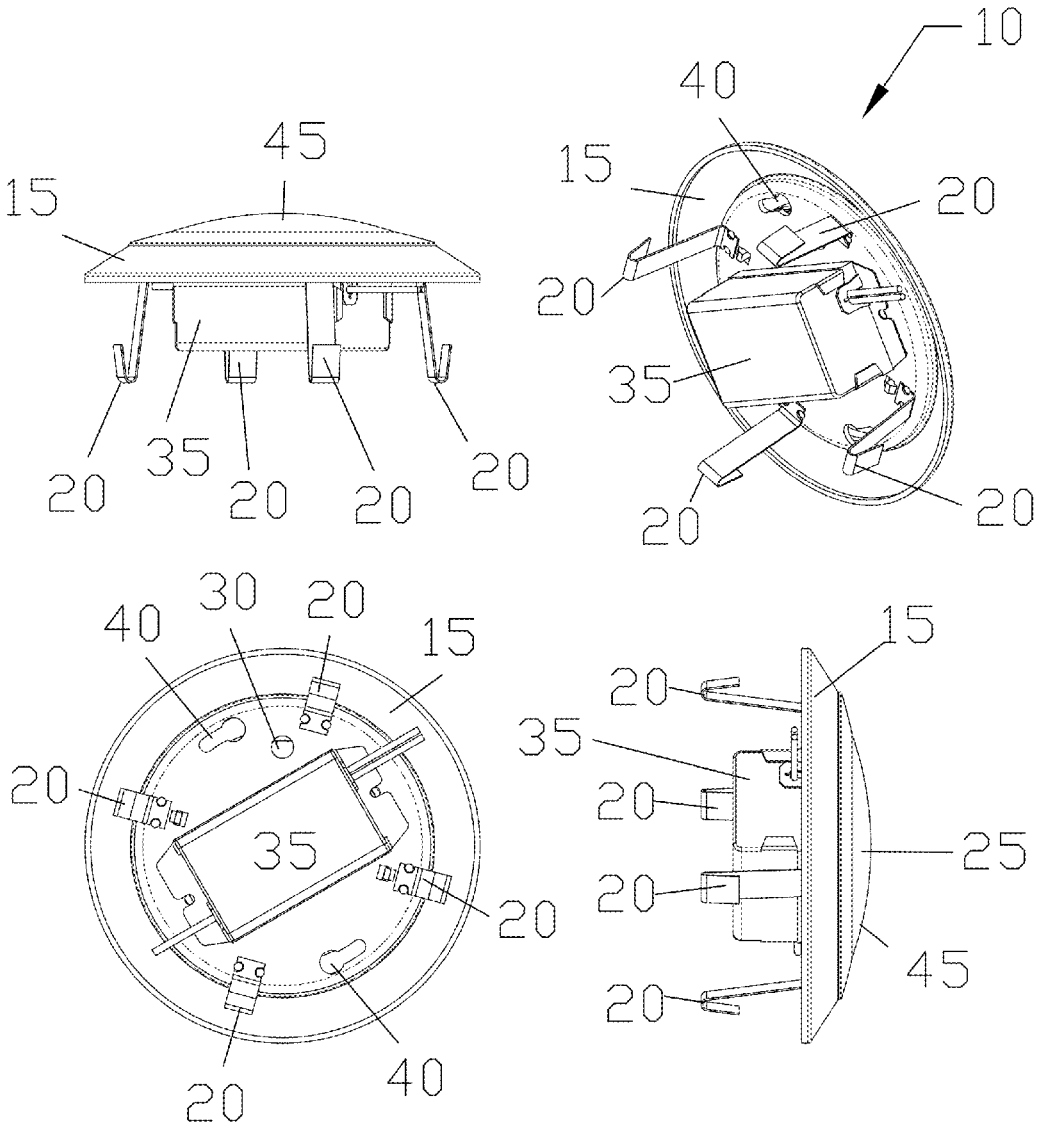
FIG. 2 shows the preferred embodiment of the present invention of a 4" LED light in back, side, and isometric views showing the main metal plate, removable mounting bracket and springs, LED circuit board (not shown), optional external dimmable LED driver, and a diffusion lens.

FIG. 2 shows the preferred embodiment of the present invention of a 4" LED light 10 in back, side, and isometric views. LED light 10 consists of a main metal dish 15 with four mounting clips 20 centered on the periphery of metal dish 15. Clips 20 are preferably made of steel spring material and fastened to metal dish 15. An LED circuit board or COB 25 (not shown) is attached to the opposite side of metal dish 15. Power wires from LED circuit board or COB 25 (not shown) are fed through a clearance passage hole 30 to the back of metal dish 15 for direct connection to an external LED driver 35. Mounting screw clearance holes 40 are provided on metal dish 15 for attaching LED light 10 to a standard junction box (not shown). Lastly, diffusion lens 45 is attached to the front of metal dish 15 to cover and protect LED circuit board or COB 25 (not shown) from dust and damage and provides the proper optics to project an even and diffused light from LED light 10.

Figure 3:
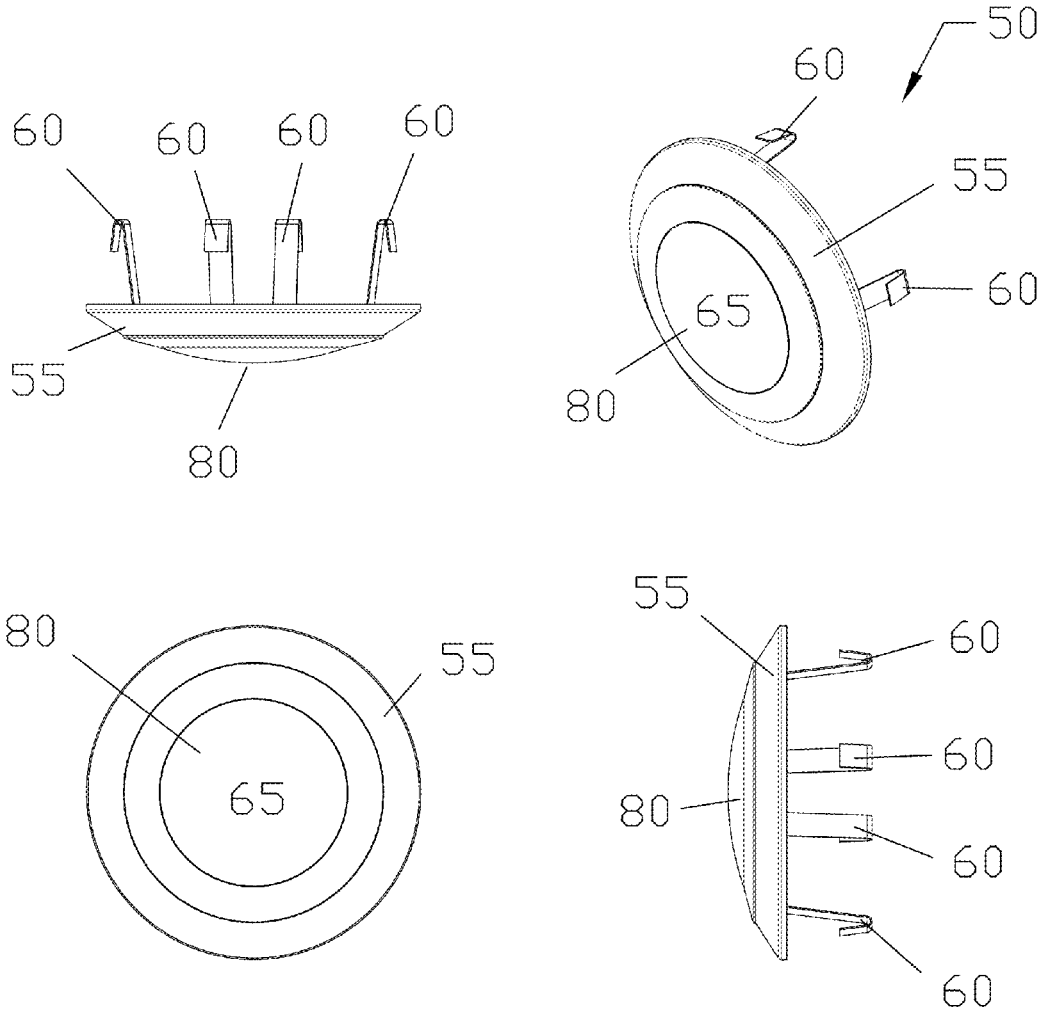
FIG. 3 shows an alternate embodiment of the present invention of a 4" LED light in front, sides, and isometric views showing the main metal plate, removable mounting bracket and springs, dimmable AC LED circuit board (not shown), and a diffusion lens.

FIG. 3 shows an alternate embodiment of the present invention of a 4" LED light 50 in front, side, and isometric views. LED light 50 consists of a main metal dish 55 with four mounting clips 60 centered on the periphery of metal dish 55. Clips 60 are preferably made of steel spring material and fastened to metal dish 55. A dimmable AC LED circuit board or AC COB 65 (not shown) is attached to the opposite side of metal dish 55. Power wires from dimmable AC LED circuit board or AC COB 65 (not shown) are fed through a clearance passage hole 70 to the back of metal dish 55 for direct connection to AC power (not shown). Mounting screw clearance holes 75 are provided on metal dish 55 for attaching LED light 50 to a standard junction box (not shown). Lastly, diffusion lens 80 (not shown) is attached to the front of metal dish 55 to cover and protect dimmable AC LED circuit board or AC COB 65 (not shown) from dust and damage, and provides the proper optics to project an even and diffused light from LED light 50.

Figure 4:
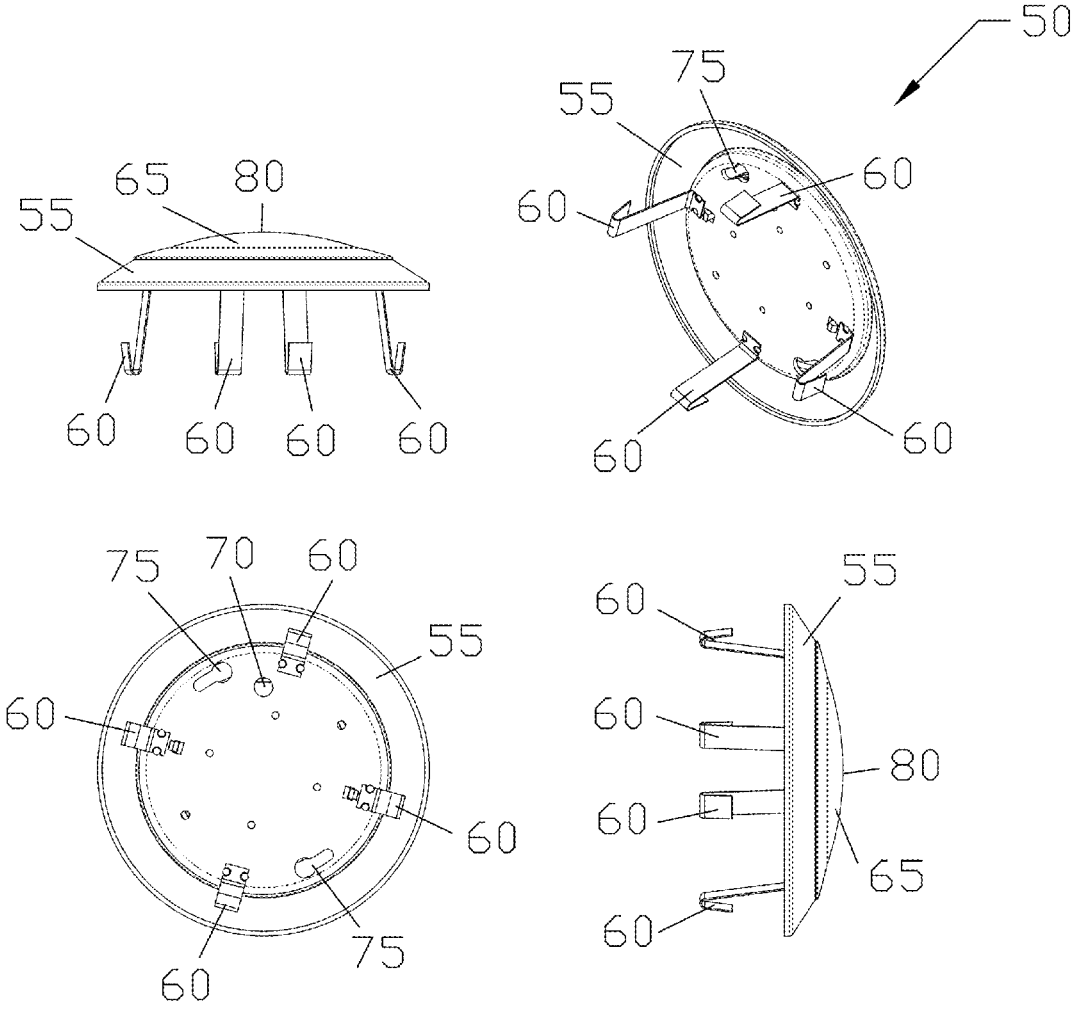
FIG. 4 shows an alternate embodiment of the present invention of a 4" LED light in back, sides, and isometric views showing the main metal plate, removable mounting bracket and springs, dimmable AC LED circuit board (not shown), and a diffusion lens.

FIG. 4 shows an alternate embodiment of the present invention of a 4" LED light 50 in back, side, and isometric views LED light 50 consists of a main metal dish 55 with four mounting clips 60 center around the periphery of metal dish 55. Clips 60 are preferably made of steel spring material and fastened to metal dish 55. A dimmable AC LED circuit board or AC COB 65 (not shown) is attached to the opposite side of metal dish 25. Power wires from dimmable AC LED circuit board or AC COB 65 (not shown) are fed through a clearance passage hole 70 to the back of metal dish 55 for direct connection to AC power (not shown). Mounting screw clearance holes 75 are provided on metal dish 55 for attaching LED light 50 to a standard junction box (not shown). Lastly, diffusion lens 80 is attached to the front of metal dish 55 to cover and protect dimmable AC LED circuit board or AC COB 65 (not shown) from dust and damage, and provides the proper optics to project an even and diffused light from LED light 50.

Figure 5:
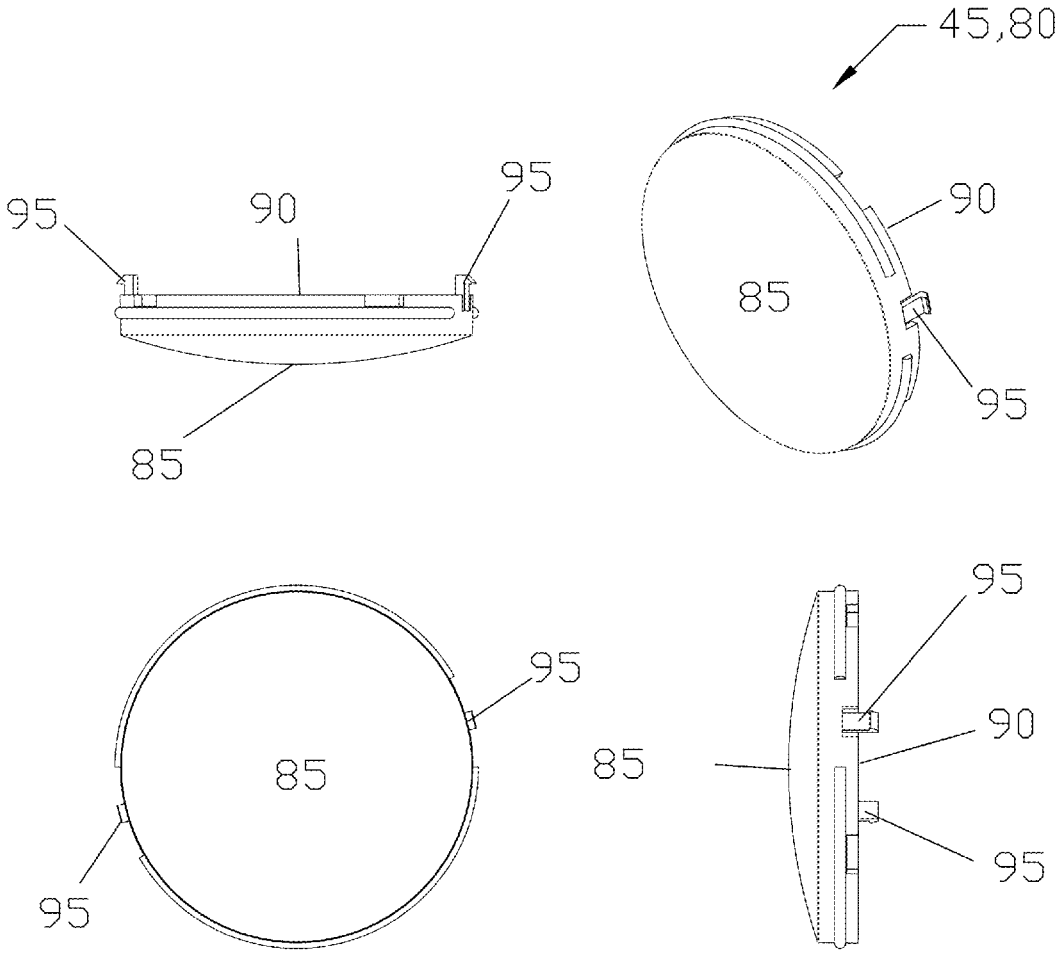
FIG. 5 shows a typical diffusion lens that can be used in both embodiments of the present inventions of a 4" LED light as shown in FIGS. 1, 2, 3, and 4.

FIG. 5 shows a typical diffusion lens 45, 80 that can be used in both preferred and alternate embodiments of the present inventions of a 4" LED light 10, 50 as shown in FIGS. 1, 2, 3, and 4. Diffusion lens 45, 80 is shown with a front convex side 85 and a back concave side 90. Back concave side 90 faces the LEDs (not shown) and protects them. Diffusion lens 45, 80 is preferably made out of a plastic material to be lightweight and will diffuse the light beam projected out by the LEDs (not shown) from front convex side 85. There is also provided on diffusion lens 45, 80 mounting tabs 95 for secure and tool free attachment of the diffusion lens 45, 80 to LED light 10, 50. It should be noted that someone skilled in the arts can use other means for attaching the diffusion lens 45, 80 to the LED light 10, 50 besides incorporating mounting tabs 95 including, but not limited to glue, adhesive, friction lock, screw and thread, tape, press fit, etc.

Figure 6:
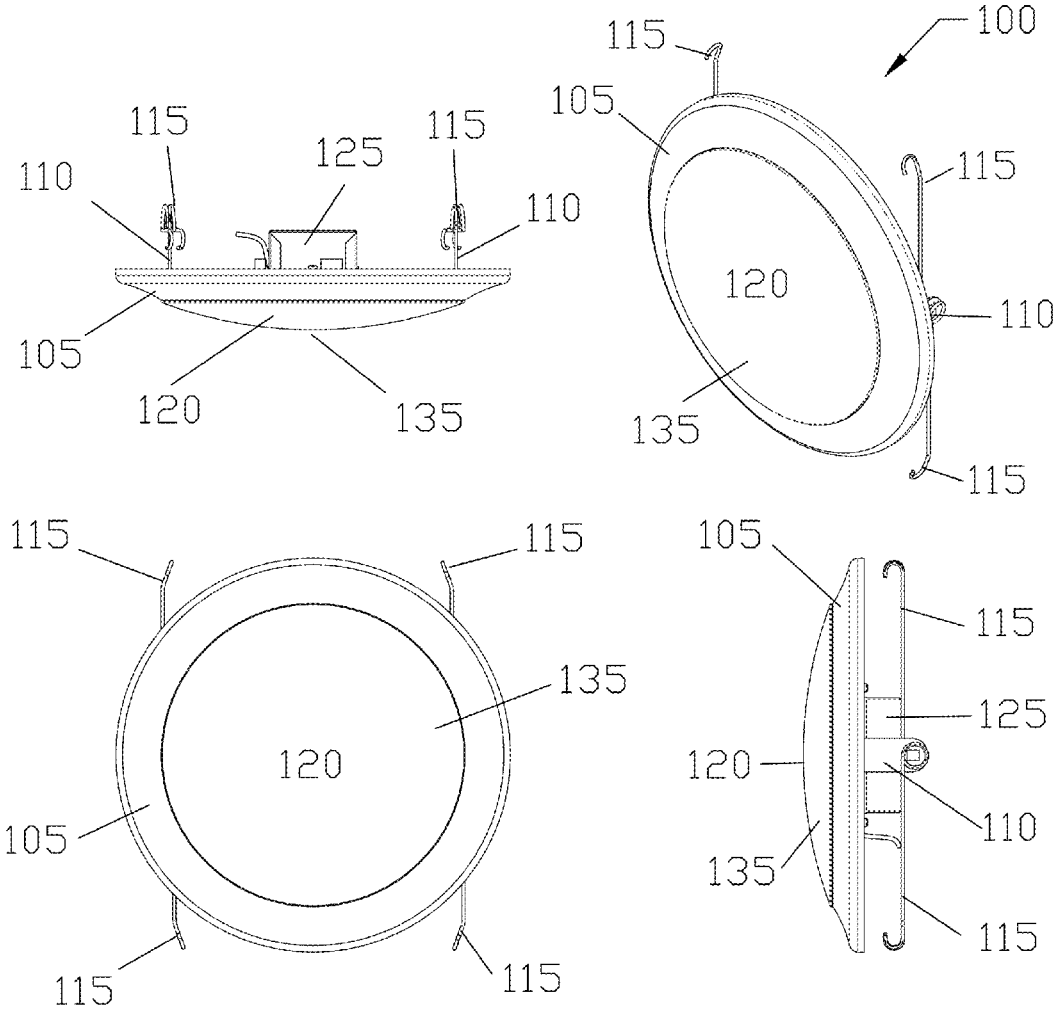
FIG. 6 shows the preferred embodiment of the present invention of a 6" LED light in front, side, and isometric views showing the main metal plate, removable mounting bracket and springs, LED circuit board (not shown), optional external dimmable LED driver, and a diffusion lens.

FIG. 6 shows the preferred embodiment of the present invention of a 6" LED light 100 in front, side, and isometric views. LED light 100 consists of a main metal dish 105 with two sets of mounting brackets 110 and springs 115 each centered on the periphery of metal dish 105. Mounting brackets 110 are made of metal and springs 115 are preferably made of spring steel attached to mounting brackets 110 and all fastened to metal dish 105. An LED circuit board or COB 120 (not shown) is attached to the opposite side of metal dish 105. Power wires from LED circuit board or COB 120 (not shown) are fed through a clearance passage hole (not shown) to the back of metal dish 105 for direct connection to an external dimmable LED driver 125. Mounting screw clearance holes 130 are provided on metal dish 105 for attaching LED light 100 to a standard junction box (not shown). Lastly, diffusion lens 135 is attached to the front of metal dish 105 to cover and protect LED circuit board or COB 120 (not shown) from dust and damage, and provides the proper optics to project an even and diffused light from LED light 100.

Figure 7:
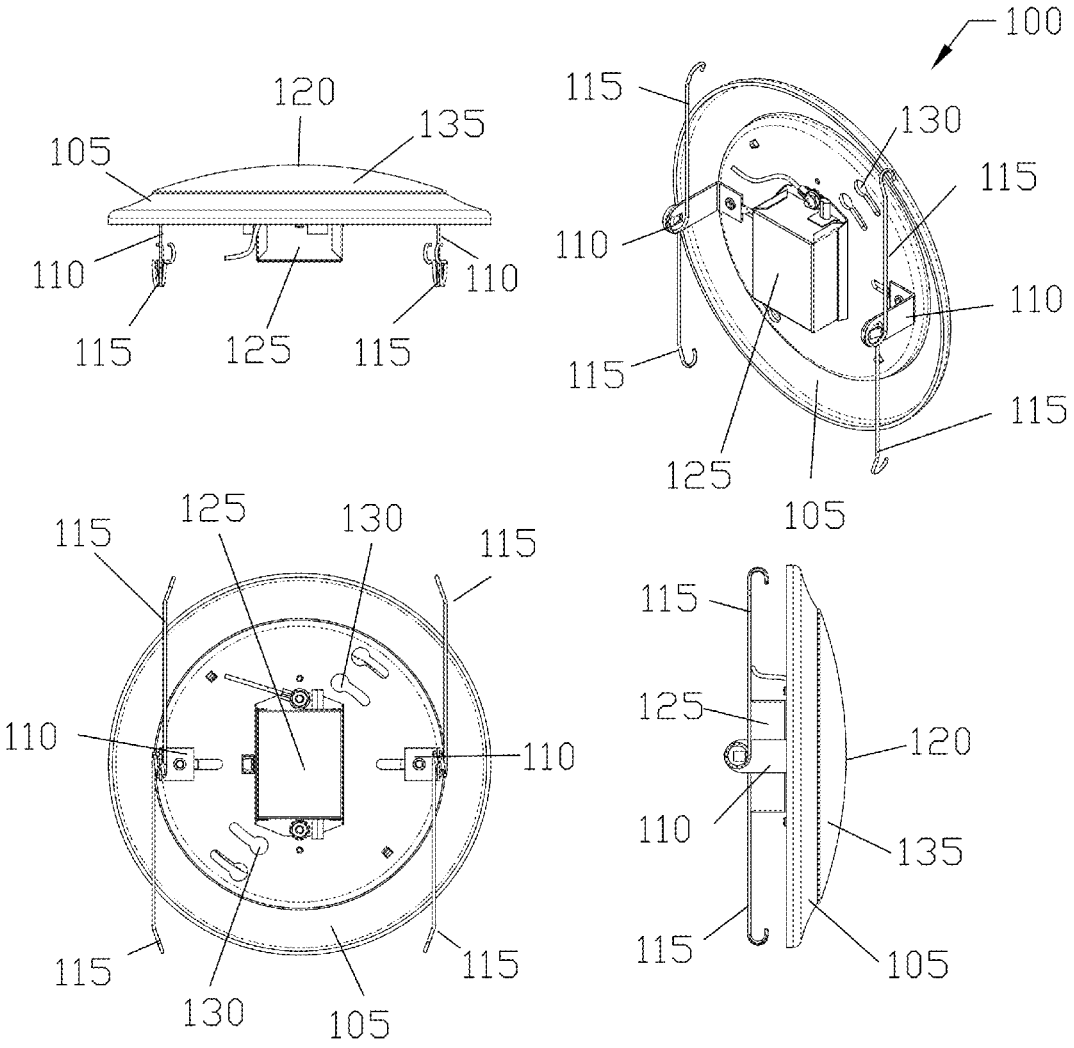
FIG. 7 shows the preferred embodiment of the present invention of a 6" LED light in back, side, and isometric views showing the main metal plate, removable mounting bracket and springs, LED circuit board (not shown), optional external dimmable LED driver, and a diffusion lens.

FIG. 7 shows the preferred embodiment of the present invention of a 6" LED light 100 in back, side, and isometric views. LED light 100 consists of a main metal dish 105 with two sets of mounting brackets 110 and springs 115 each centered on the periphery of metal dish 105. Mounting brackets 110 are made of metal and springs 115 are preferably made of spring steel attached to mounting brackets 110 and all fastened to metal dish 105. An LED circuit board or COB 120 (not shown) is attached to the opposite side of metal dish 105. Power wires from LED circuit board or COB 120 (not shown) are fed through a clearance passage hole (not shown) to the back of metal dish 105 for direct connection to an external dimmable LED driver 125. Mounting screw clearance holes 130 are provided on metal dish 105 for attaching LED light 100 to a standard junction box (not shown). Lastly, diffusion lens 135 is attached to the front of metal dish 105 to cover and protect LED circuit board or COB 120 (not shown) from dust and damage, and provides the proper optics to project an even and diffused light from LED light 100.

Figure 8:
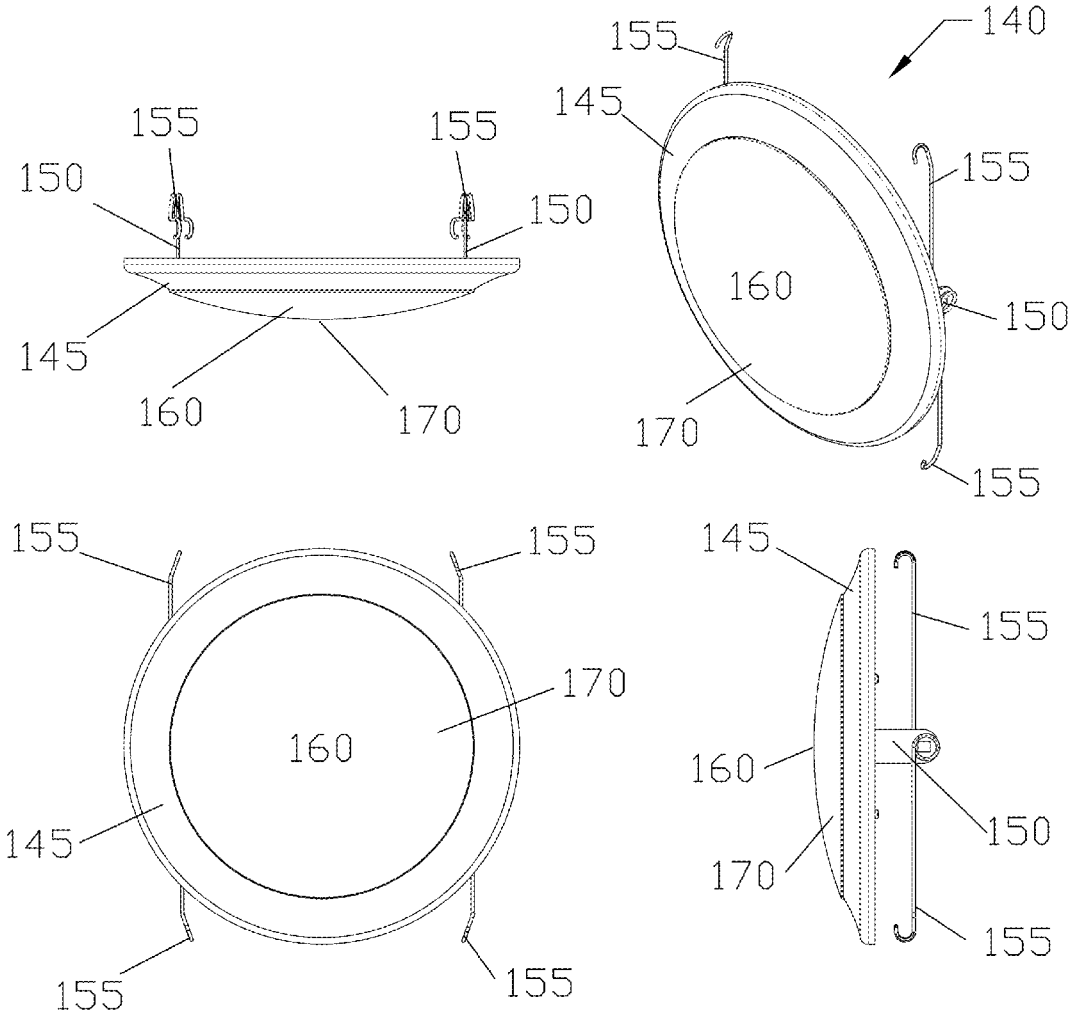
FIG. 8 shows an alternate embodiment of the present invention of a 6" LED light in front, sides, and isometric views showing the main metal plate, removable mounting bracket and springs, dimmable AC LED circuit board (not shown), and a diffusion lens.

FIG. 8 shows an alternate embodiment of the present invention of a 6" LED light 140 in front, side, and isometric views. LED light 140 consists of a main metal dish 145 with two sets of mounting brackets 150 and springs 155 each centered on the periphery of metal dish 145. Mounting brackets 150 are made of metal and springs 155 are preferably made of spring steel attached to mounting brackets 150 and all fastened to metal dish 145. A dimmable AC LED circuit board or AC COB 160 (not shown) is attached to the opposite side of metal dish 145. Power wires from dimmable AC LED circuit board or AC COB 160 (not shown) are fed through a clearance passage hole (not shown) to the back of metal dish 145 for direct connection to AC power (not shown). Mounting screw clearance holes 165 are provided on metal dish 145 for attaching LED light 140 to a standard junction box (not shown). Lastly, diffusion lens 170 is attached to the front of metal dish 145 to cover and protect dimmable AC LED circuit board or AC COB 160 (not shown) from dust and damage, and provides the proper optics to project an even and diffused light from LED light 140.

Figure 9:
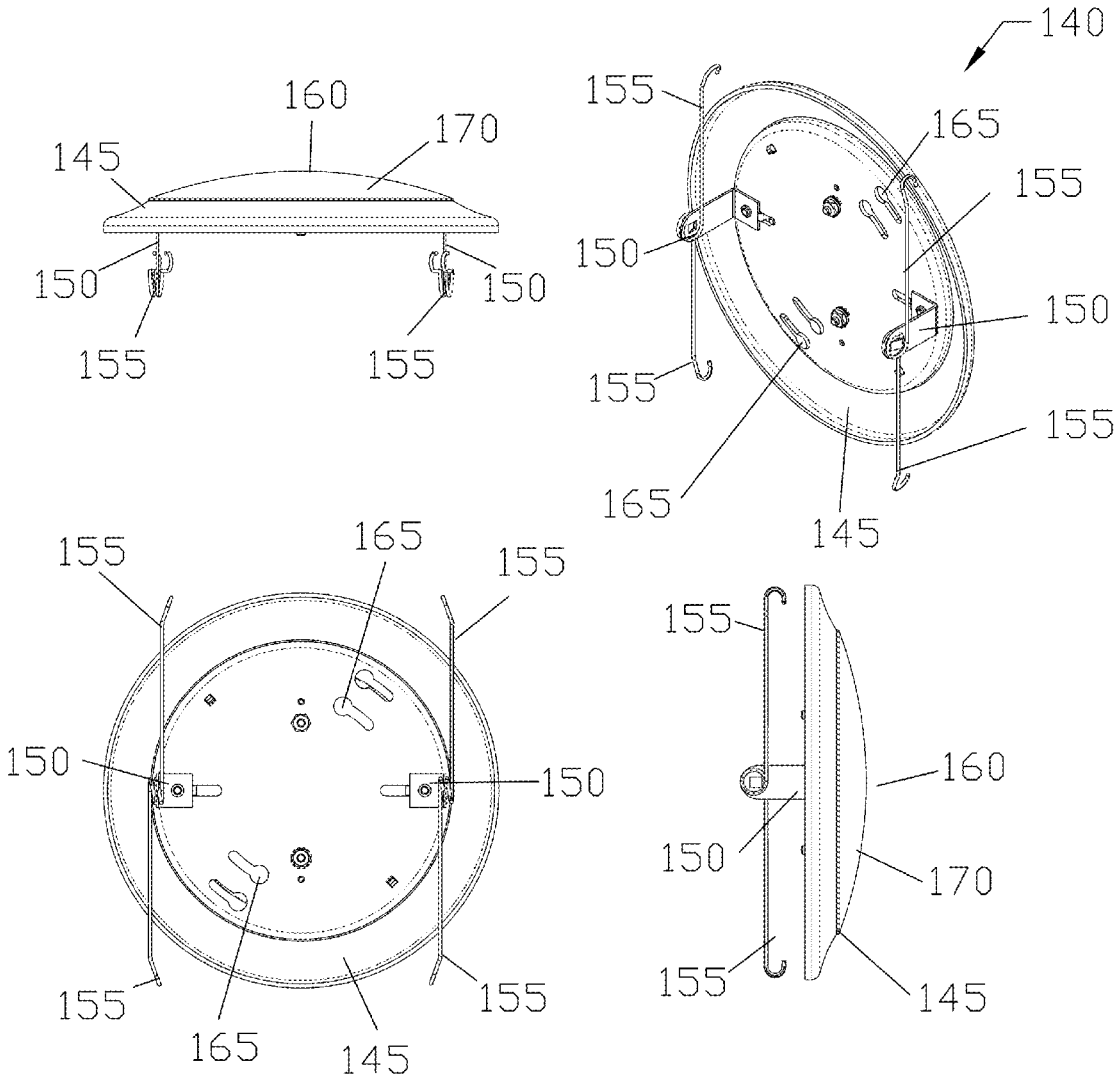
FIG. 9 shows an alternate embodiment of the present invention of a 6" LED light in back, sides, and isometric views showing the main metal plate, removable mounting bracket and springs, dimmable AC LED circuit board (not shown), and a diffusion lens.

FIG. 9 shows an alternate embodiment of the present invention of a 6" LED light 140 in back, side, and isometric views. LED light 140 consists of a main metal dish 145 with two sets of mounting brackets 150 and springs 155 each centered on the periphery of metal dish 145. Mounting brackets 150 are made of metal and springs 155 are preferably made of spring steel attached to mounting brackets 150 and all fastened to metal dish 145. A dimmable AC LED circuit board or AC COB 160 (not shown) is attached to the opposite side of metal dish 145. Power wires from dimmable AC LED circuit board or AC COB 160 (not shown) are fed through a clearance passage hole (not shown) to the back of metal dish 145 for direct connection to AC power (not shown). Mounting screw clearance holes 165 are provided on metal dish 145 for attaching LED light 140 to a standard junction box (not shown). Lastly, diffusion lens 170 is attached to the front of metal dish 145 to cover and protect dimmable AC LED circuit board or AC COB 160 (not shown) from dust and damage, and provides the proper optics to project an even and diffused light from LED light 140.

Figure 10:
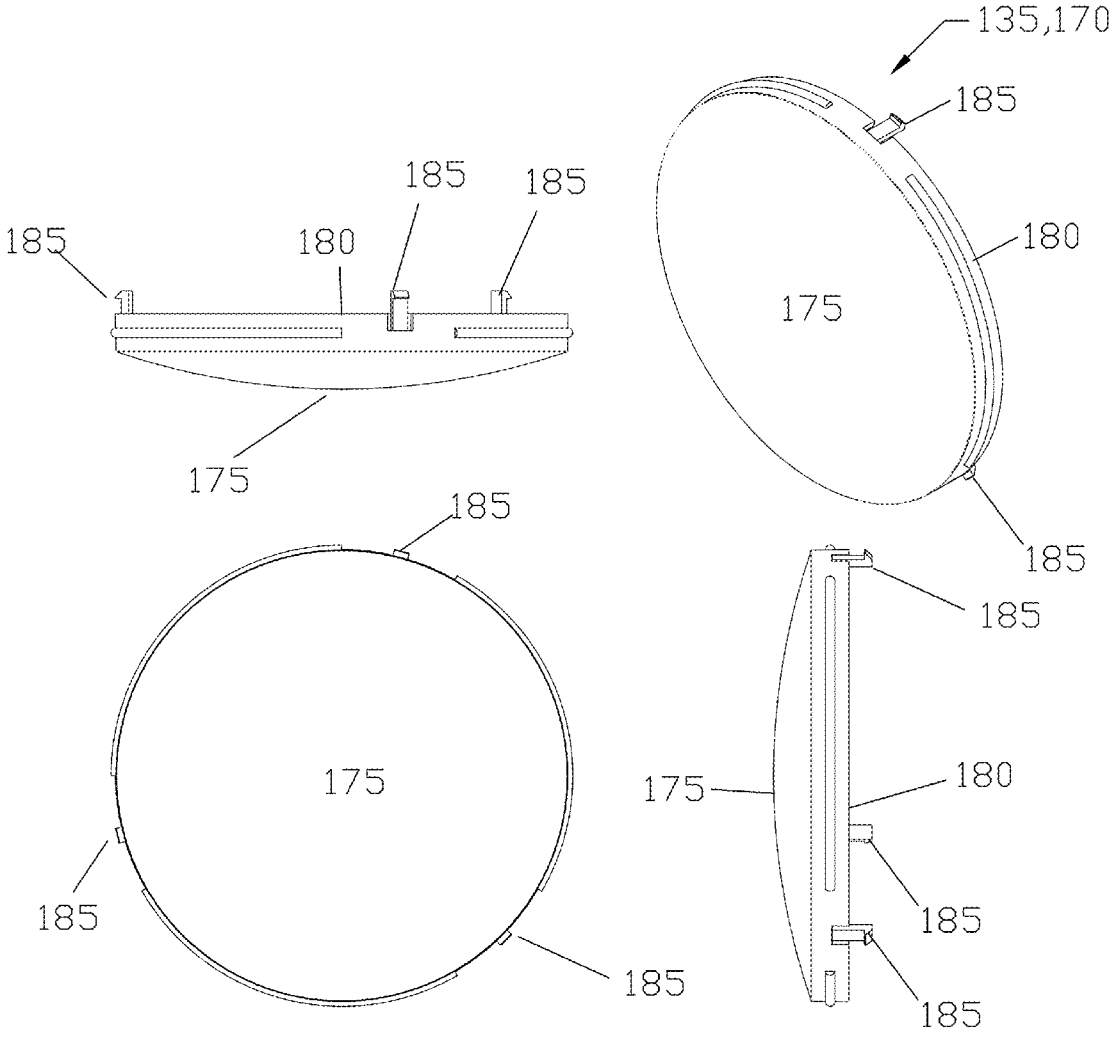
FIG. 10 shows a typical diffusion lens that can be used in both embodiments of the present inventions of a 6" LED light as shown in FIGS. 6, 7, 8, and 9.

FIG. 10 shows a typical diffusion lens 135, 170 that can be used in both preferred and alternate embodiments of the present inventions of a 6" LED light 100, 140 as shown in FIGS. 6, 7, 8, and 9. Diffusion lens 135, 170 is shown with a front convex side 175 and a back concave side 180. Back concave side 180 faces the LEDs (not shown) and protects them. Diffusion lens 135, 170 is preferably made out of a plastic material to be lightweight and will diffuse the light beam projected out by the LEDs (not shown) from front convex side 175. There is also provided on diffusion lens 135, 170 mounting tabs 185 for secure and tool free attachment of the diffusion lens 135, 170 to LED light 100, 140. It should be noted that someone skilled in the arts can use other means for attaching the diffusion lens 135, 170 to the LED light 100, 140 besides incorporating mounting tabs 185 including, but not limited to glue, adhesive, friction lock, screw and thread, tape, press fit, etc.

FIG. 11 shows an engineering testing record of the thermals done on the LED circuit board installed in a 4" LED light 10, 50 of the preferred embodiment of the present invention as shown in FIGS. 1 and 2. The LEDs used in the test are 5630 mid-power LEDs from Seoul Semiconductor with an operational temperature rating of 70.0 deg. C. Note that any industry 5630 or similar LED package can be used and should produce similar results. From the test data, one can see that the maximum temperature measured at the LED was 64.7 degrees Celsius at an ambient temperature of 23.7 degrees C. Normalized to 25.0 deg. C., the maximum LED temperature for the 4" LED light 10, 50 is 66.0 deg. C., which is below the 70.0 deg. C. rated operating temperature of the Seoul Semiconductor 5630 mid-power LEDs.

FIG. 12 shows an engineering testing record of the thermals done on the LED circuit board installed in a 6" LED light 100, 140 of the preferred embodiment of the present invention as shown in FIGS. 6 and 7. The LEDs used in the test are 5630 mid-power LEDs from Seoul Semiconductor with an operational temperature rating of 70.0 deg. C. Note that any industry 5630 or similar LED package can be used and should produce similar results. From the test data, one can see that the maximum temperature measured at the LED was 66.4 degrees Celsius at an ambient temperature of 23.8 degrees C. Normalized to 25.0 deg. C., the maximum LED temperature for the 6" LED light 100, 140 is 67.6 deg. C., which is below the 70.0 deg. C. rated operating temperature of the Seoul Semiconductor 5630 mid-power LEDs.

It will be understood that various changes in the details, materials, types, values, and arrangements of the components that have been described and illustrated in order to explain the nature of this invention may be made by those skilled in the art without departing from the principle and scope of the invention as expressed in the following claims.

What is claimed is:

1. An LED lighting module for a recessed down light can including:

at least one LED array mounted to a circuit board, a combination heat sink and trim ring unitary metal dish for attaching said at least one LED array mounted to a circuit board, at least two removable springs positioned on the periphery of said metal dish for retrofitting said LED lighting module to said recessed down light can, and a diffusion lens mounted over said at least one LED array mounted to a circuit board in said LED lighting module.

2. An LED lighting module for a recessed down light can according to claim 1 further including: an external dimmable LED driver connected to said at least one LED array mounted to a circuit board.

3. An LED lighting module for installation as a down light including:

at least one LED array mounted to a circuit board, a combination heat sink and trim ring unitary metal dish for attaching said at least one LED array mounted to a circuit board, at least two screw clearance holes provided on said metal dish for mounting said LED lighting module to a junction box, and a diffusion lens mounted over said at least one LED array mounted to a circuit board in said LED lighting module.

4. An LED lighting module for installation as a down light according to claim 3 further including: an external dimmable LED driver connected to said at least one LED array mounted to a circuit board.

* * * * *